US005458471A

United States Patent [19]

Ni

[11] Patent Number: 5,458,471

[45] Date of Patent: Oct. 17, 1995

[54] SCROLL-TYPE FLUID DISPLACEMENT DEVICE HAVING HIGH BUILT-IN VOLUME RATIO AND SEMI-COMPLIANT BIASING MECHANISM

[76] Inventor: Shimao Ni, 345 Jamestown Ave., Westmont, Ill. 60559

[21] Appl. No.: 379,098

[22] Filed: Jan. 26, 1995

Related U.S. Application Data

[63] Continuation of Ser. No. 150,774, Nov. 12, 1993, abandoned, which is a continuation of Ser. No. 930,758, Aug. 14, 1992, abandoned.

[51] Int. Cl.[6] ..... F01C 1/04

[52] U.S. Cl. ..... 418/1; 418/55.2; 418/55.5; 418/57

[58] Field of Search ..... 418/1, 55.2, 55.5, 418/57, 150

[56] References Cited

U.S. PATENT DOCUMENTS

| | | | |
|---|---|---|---|
| 801,182 | 10/1905 | Creux | 418/55.2 |
| 3,600,114 | 8/1971 | Dvorak et al. | 418/55.5 |
| 3,874,827 | 4/1975 | Young | 418/55.2 |
| 3,884,599 | 5/1975 | Young et al. | 418/55.5 |
| 3,989,422 | 11/1976 | Guttinger | 418/55.2 |
| 3,994,636 | 11/1976 | McCullough et al. | 418/55.4 |
| 4,216,661 | 8/1980 | Tojo et al. | 418/55.5 |
| 4,357,132 | 11/1982 | Kousokabe | 418/55.5 |
| 4,477,238 | 10/1984 | Terauchi | 418/55.2 |
| 4,496,296 | 1/1985 | Arai et al. | 418/55.5 |
| 4,527,964 | 7/1985 | Mitsui et al. | 418/55.2 |
| 4,558,997 | 12/1985 | Sakata et al. | 418/55.2 |
| 4,609,334 | 9/1986 | Muir et al. | 418/55.2 |
| 4,611,975 | 9/1986 | Blain | 418/55.5 |
| 4,877,382 | 10/1989 | Caillat et al. | 418/55.5 |
| 4,958,993 | 9/1990 | Fujio | 418/55.5 |
| 5,102,316 | 4/1992 | Caillat et al. | 418/57 |

FOREIGN PATENT DOCUMENTS

| | | | |
|---|---|---|---|
| 60-98185 | 6/1985 | Japan | 418/55.2 |
| 3-11102 | 1/1991 | Japan | 418/55.2 |
| 3-237283 | 10/1991 | Japan | 418/55.5 |
| 4-5490 | 1/1992 | Japan | 418/55.5 |
| 4-121482 | 4/1992 | Japan | 418/55.2 |

*Primary Examiner*—John J. Vrablik

*Attorney, Agent, or Firm*—Willian Brinks Hofer Gilson & Lione

[57] ABSTRACT

A scroll-type fluid displacement apparatus has two interfitting spiral-shaped scroll members which have predetermined geometric configurations. The novel design provides desired displacement and a high built-in volume ratio, while at the same time achieving the optimum number of turns. The two scroll members can be either identical or non-identical. One scroll member is non-orbital and movable along its center axis. The non-orbital scroll member is urged by forces, mechanical or hydraulic, toward the other scroll member and is stopped by a positioning mechanism such that gaps are maintained between tips of one scroll member and bases of the other scroll member. A stabilizing mechanism prevents the scroll members from tipping. When abnormal operating conditions arise, for example, when contaminants or incompressible liquids move between the scroll members, or, when the tips and bases of the scroll members contact each other due to abnormal thermal growth, the non-orbital scroll member moves against the urging force along the direction of its center axis. Thus, galling may be prevented.

18 Claims, 10 Drawing Sheets

SCROLL-TYPE FLUID DISPLACEMENT DEVICE HAVING HIGH BUILT-IN VOLUME RATIO AND SEMI-COMPLIANT BIASING MECHANISM

This application is a continuation of application Ser. No. 08/150,774, filed Nov. 12, 1993, abandoned, which is a continuation of application Ser. No. 07/930,758, filed Aug. 14, 1992, abandoned.

BACKGROUND OF THE INVENTION

This invention relates in general to a fluid displacement device. More particularly, it relates to an improved scroll-type fluid displacement device which achieves a high built-in volume ratio without compromising other optimum design parameters. This invention also relates to a "semi-compliant" mechanism for maintaining the desired operative relationship between the scroll members of a scroll-type fluid displacement device.

Scroll-type fluid displacement devices are well-known in the art. For example, U.S. Pat. No. 801,182 to Creux discloses a scroll device including two scroll members each having a circular end plate and a spiroidal or involute scroll element. These scroll elements have identical spiral geometries and are interfit at an angular and radial offset to create a plurality of line contacts between their spiral curved surfaces. Thus, the interfit scroll elements seal off and define at least one pair of fluid pockets. By orbiting one scroll element relative to the other, the line contacts are shifted along the spiral curved surfaces, thereby changing the volume of the fluid pockets. This volume increases or decreases depending upon the direction of the scroll elements' relative orbital motion, and thus, the device may be used to compress or expand fluids.

Referring to FIGS. 1*a*–1*d*, the general operation of conventional scroll compressor will now be described. FIGS. 1*a*–1*d* schematically illustrate the relative movement of interfitting spiral-shaped scroll elements, 1 and 2, to compress a fluid. The scroll elements, 1 and 2, are angularly and radially offset and interfit with one another. FIG. 1*a* shows that the outer terminal end of each scroll element is in contact with the other scroll element, i.e., suction has just been completed, and a symmetrical pair of fluid pockets A1 and A2 have just been formed.

Each of FIGS. 1*b*–1*d* shows the position of the scroll elements at a particular drive shaft crank angle which is advanced from the angle shown in the preceding figure. As the crank angle advances, the fluid pockets, A1 and A2, shift angularly and radially towards the center of the interfitting scroll elements with the volume of each fluid pocket A1 and A2 being gradually reduced. Fluid pockets A1 and A2 merge together at the center portion A as the crank angle passes from the state shown in FIG. 1*c* to the state shown in FIG. 1*d*. The volume of the connected single pocket is further reduced by an additional drive shaft revolution. During the relative orbital motion of the scroll elements, outer spaces, which are shown as open in FIGS. 1*b* and 1*d*, change to form new sealed off fluid pockets in which the next volume of fluid to be compressed is enclosed (FIG. 1*c* and 1*a* show these states).

FIG. 2 diagrammatically illustrates the compression cycle that takes place in one of the fluid pockets, A1 or A2, as it converges toward the center portion A. FIG. 2 also illustrates the relationship between fluid pressure and volume in the fluid pocket.

The compression cycle begins (FIG. 1*a*) when the fluid pockets are sealed. In FIG. 1*a*, the suction phase has just finished. The fluid pressure in one of the fluid pockets in the suction phase is shown at point H in FIG. 2.

The volume of the pocket at point H is the displacement, $V_H$. The volume of the fluid pocket is continuously reduced and the fluid is continuously compressed as the scroll element is rotated to a certain crank angle. This state is shown by point L in FIG. 2. The volume ($V_L$) of the pocket at state L is defined as the final compression pocket volume. Immediately after passing point L, the fluid pockets, A1 and A2, are connected to one another and simultaneously connected to the central volume A which is filled with undischarged high pressure fluid.

The ratio of the suction pocket volume, $V_H$, to the final compression pocket volume, $V_L$, is defined as the built-in volume ratio, $R_V$. The ratio of the pressure ($P_L$) at state L to the pressure ($P_H$) at state H is defined as the pressure ratio.

Referring back to FIG. 2, as the crank angle passes state L, the fluid in the connected fluid pockets, i.e. the central volume A, will undergo one of the following three processes:

1) Ideal compression: The ideal compression process occurs when the fluid pressure ($P_{d1}$) in the central volume A, equals the pressure in the final compression pocket $P_L$. The fluid discharges without pressure change as shown by the line L—L in FIG. 2. In this process the built-in volume ratio of the scroll members perfectly matches the operating condition, and hence, high energy efficiency is achieved in the compression process.

2) Overcompression: In this case, the fluid pressure ($P_L$) in the final compression pocket at point n is higher than the pressure in the central volume $P_{d2}$. As the crank angle passes point L, the fluid in the final compression pocket suddenly expands into the central volume and reduces its pressure until it equals $P_{d2}$ as shown by point M in FIG. 2. The shadowed triangle LMO represents the energy loss due to overcompression.

3) Undercompression: In this case $P_L$ is lower than the discharge pressure $P_{d3}$. As the crank angle passes point L, the fluid in the central volume rapidly expands into the final compression pockets, and the fluid pressure in the final compression pockets $P_L$ rises instantly to $P_{d3}$ as shown by point N in FIG. 2. The fluid in the final compression pocket then discharges at line N—N. The shadowed triangle LNT represents the energy loss due to undercompression.

In order to achieve high energy efficiency, it is very important that the built-in volume ratio be designed as close to the ideal compression process as possible. Different applications require different built-in volume ratios to realize their respective ideal compression process. For example, a heat pump would require a ratio of about 4, an air compressor would require a ratio of about 5 and a low temperature refrigeration system would require a high ratio of about 10 or even higher. However, most conventional scroll devices cannot achieve these ratios. For example, in U.S. Pat. No. 3,884,599, the spiral elements of the scroll members span more than two but less than three full turns. Thus, the built-in volume ratio for this type of design is only about 2.5.

U.S. Pat. No. 4,477,238 discloses one method for achieving a high pressure ratio in a scroll-type displacement device by leaving the built-in volume ratio unchanged and placing a discharge valve, for instance, a reed valve, at the discharge port. Although this approach reduces energy loss, the valve is vulnerable to breakdown, and therefore, it increases the failure rate substantially. It also raises the noise level due to the vibration and impacting action of the valve.

Another approach to the problem is to increase the number of the turns in the spiral-shaped scroll elements. FIGS. 15 and 16 of U.S. Pat. No. 801,182 disclose one example of this approach. The scroll elements span approximately four full turns, and the built-in volume ratio can reach higher than three. Further increase in the number of turns, however, will increase machining costs and machining precision requirements. Increasing the number of turns may also be extremely impractical due to displacement requirements or space limitations.

The optimum number of turns for a scroll element is greater than two but less than three. With the optimum number of turns, the suction and discharge areas are always separated by at least one sealed off pocket. This is important in order to reduce the undesired leakage flow of both mass and heat between the two areas.

U.S. Pat. No. 3,989,422 discloses a method of constructing spiral-shaped scroll elements having a high built-in volume ratio and the optimum number of turns. According to this method, the first turn of the scroll element is designed in a conventional manner. In order to reduce the volume of the final compression pocket, and thus increase the built-in volume ratio, the scroll element suddenly and dramatically reduces its radius of curvature by moving the center of its generating circle toward one side. This method has serious shortcomings. As the central portion of the scroll element moves towards one side of its end plate, greater forces and moments are created due to the increased distance between the location where the compression forces act and the center of the end plate during its orbiting motion. To balance these forces and moments, the '422 patent provides a structure with multiple pairs of scroll elements in which the forces and moments cancel each other out. However, this structure increases machining time, machining precision requirements and material costs due to the complex structure and increased number of the scroll elements. Furthermore, the larger space requirements of the complex multiple scroll structure make it geometrically impractical to implement.

There are currently three approaches to maintaining an operative relationship between the scroll members in the "axial" direction (as measured linearly along the center axes of the scroll elements). These approaches may be referred to as "constant gap," "axially compliant," and "semi-compliant."

The constant gap approach was used in early devices as shown in U.S. Pat. No. 801,182 to Creux. In this approach, the relationship between the scroll members in the axial direction remains unchanged after the device is assembled. The tips of either scroll member do not contact the base of the opposing scroll member during normal operation. In order to maintain proper gaps between the scroll members and at the same time achieve high efficiency, extremely precise machining is required. Another more serious shortcoming of this approach is its inability to handle abnormal situations. If there are contaminants or incompressible fluid between the scroll members, or if the scroll members come into contact with each other due to excessive thermal growth, the scroll members could be damaged by galling.

To overcome the shortcomings of the constant gap approach, various types of axially compliant schemes have been developed. These schemes can be categorized as two types: "tip-seal" and "fully axially compliant."

The tip-seal scheme is shown in FIG. 10, and a further example is disclosed in U.S. Pat. No. 3,994,636 to McCullough et al. As illustrated in FIG. 10, a groove 501 is made in the middle of the tips of two scroll members, 502 and 503. A seal element 504 is loosely fitted in the groove 501 and urged by mechanical and/or hydraulic forces (not shown) into contact with the base 505 of the other scroll member, thus keeping fluid from leaking across the spiral scroll elements, 502 and 503, in the radial direction. However, the tip seal method inherently includes tangential leakage passages, as shown by lines A—A and B—B in FIG. 10, which reduce the compression efficiency. Other shortcomings of the tip seal method include friction power loss and the gradual deterioration of sealing effectiveness due to the seal elements wearing out.

In a fully axially compliant scheme, the scroll members maintain tip-base contact by mechanical or hydraulic forces, thereby sealing off the fluid pockets regardless of the pressure in the scroll device. U.S. Pat. No. 3,600,114 to Dvorak et al. discloses a scroll machine in which at least one of the scroll members is subject to axial forces, mechanical and/or hydraulic, to maintain two scroll members in sealed contact. In the '114 patent, fluid at discharge pressure is introduced to exert a bias force on the back of the end plate of scroll members. U.S. Pat. No. 3,884,599 to Young et al. discloses a fully axially compliant design in which the orbiting scroll is axially subject to a hydraulic urging force at the discharge pressure. U.S. Pat. No. 4,357,132 to Kousokabe discloses a scroll machine in which fluid at an intermediate pressure is used to urge the orbiting scroll member against the fixed scroll member. U.S. Pat. No. 4,216,661 to Tojo discloses a fully axially compliant scheme in which fluid external to the machine acts on the back of the orbiting scroll member to provide an axial bias. U.S. Pat. No. 4,611,975 to Blain discloses a fully axially compliant scheme in which an annular chamber formed at the interface of the scroll members is connected to a relatively low pressure source to "suck" the two scroll members together. U.S. Pat. No. 4,496,296 to Arai discloses a fully axially complaint scheme in which two pressure chambers are formed at the back of the orbiting scroll member. These pressure chambers are connected to the compression pockets at an intermediate pressure and to the central volume at the discharge pressure. This scheme maintains radial sealing of the scroll members over a wide operating range. U.S. Pat. Nos. 4,767,293 and 4,877,382, both to Caillat et al., disclose a fully axially compliant scheme in which a non-orbiting scroll member with resilient mounting means is urged toward the orbiting scroll member by gas at an intermediate and/or discharge pressure The fully axially compliant schemes have several shortcomings. For example, the gas pressure used in these schemes is often derived from the compression pockets and/or the discharge chamber, and thus, may vary in accordance with changes in the operating conditions, i.e., the suction and discharge pressure. However, these changes are not always proportional to the separating forces acting on the tips and bases of the scroll members. Thus, as a design compromise, if the bias force is sufficient for a range of operating conditions about a particular point, it would not be enough to maintain stable operation at low suction pressure and low discharge pressure. On the other hand, the same bias force would be excessive for operating conditions at high suction pressure and high discharge pressure.

Another shortcoming of the fully axially compliant scheme is that the power loss due to friction between the contacting surfaces is not negligible. For operating conditions at high suction pressure and high discharge pressure, excessive hydraulic urging forces result in large friction power loss and serious wear, sometimes even causing damage due to tip-base galling.

Still another shortcoming of the fully axially compliant scheme is that the tip-base contact results in vibration and noise.

U.S. Pat. No. 4,958,993 to Fujio discloses a third approach to maintaining gaps between scroll members. This approach may be referred to as "semi-compliant" since the gaps between the scroll members in the axial direction may be enlarged by moving one scroll member away from the other.

The '993 patent teaches that the orbiting scroll member should be made movable in the axial direction, rather than the non-orbiting scroll member. This is done to keep the number of moving parts to a minimum since the orbiting scroll member is already movable and the non-orbiting scroll member is already stationary. Moving parts are a source of unwanted vibration and noise. Also, the orbiting scroll member is typically lighter than the non-orbiting scroll member, and thus the response time of the orbiting scroll member is quicker due to its smaller inertia.

There are several problems with the semi-compliant scheme taught by the '993 patent. For example, the potential for tipping the orbiting scroll member is greatly increased by making it movable in the axial direction. As seen in FIG. 3 of this application, the orbiting scroll member is subject to a driving force, $F_d$, acting on the middle of driving pin boss 53, and to a reaction force, $F_g$, from the compressed gas acting on the middle of the vane 51. These two forces are perpendicular to the axis, S1—S1, and form a moment which tends to tip the orbiting scroll member 50 and cause it to wobble as it orbits. The '993 patent teaches a range of movements (orbiting and axial) for the orbiting scroll member which makes it extremely difficult to balance the forces and moments acting on the scroll member and thereby prevent it from tipping. If the '993 parent's orbiting scroll member tips, it creates the same unwanted noise vibration and leakage that the '993 design was intended to avoid.

The present invention provides a new method of designing the scroll elements of a scroll-type fluid displacement device. Under the present invention, the design requirements for displacement, high built-in volume ratio and optimum number of turns are all satisfied. The present invention also provides an improved semi-compliant biasing scheme in which the potential for tipping is eliminated, thereby significantly reducing the amount of unwanted noise, vibration and leakage.

SUMMARY OF THE INVENTION

Accordingly, it is an object of the present invention to provide a scroll-type fluid displacement device in which, under application of an extraordinary load—typically caused by incompressible fluid, jamming of contaminants, or tip-base contact due to abnormal or excessive deformation of the scroll elements—the non-orbiting or fixed scroll member yields axially in order to protect the device. Further, under normal operation, the axial gaps between the tips and bases of the scroll members are maintained and hydrodynamically sealed off. Thus, the present invention eliminates the detrimental effects of friction power loss, vibration, noise and wear caused by frictional contact between the tips and bases of the scroll members.

It is also an object of the present invention to provide a new method for designing a scroll-type positive displacement apparatus which provides a high built-in volume ratio, the optimum number of turns, and the necessary displacement, without the aforementioned shortcomings and limitations of known designs.

Another and more specific object of the present invention is to provide a novel construction for the scroll elements of a scroll-type displacement device wherein the scroll elements have the desired built-in volume ratio, displacement and number of turns, without causing significant unbalanced forces and moments or dramatically increasing of the complexity of the scroll elements.

Still another object of the present invention is to provide a novel construction for a scroll-type displacement device wherein the scroll elements may have either identical or non-identical basic geometric configurations.

In order to implement these and other objects, the disclosed embodiment of the present invention provides a scroll-type fluid displacement device, which includes a housing having a fluid inlet port and a fluid outlet port. A first scroll member has an end plate from which a first scroll element extends axially into the interior of the housing. A second scroll member also has an end plate from which a second scroll element extends axially. The second scroll member is movably disposed for non-rotative orbital movement relative to the first scroll member.

The first and second scroll elements interfit at an angular and radial offset to create a plurality of line contacts which define at least one pair of sealed fluid pockets. Drive means is operatively connected to the scroll members to effect their relative orbiting motion while preventing their relative rotation, thus causing the fluid pockets to change volume.

The disclosed embodiments of the present invention provide a novel method for designing the geometric configurations of the internal and external surfaces of both scroll elements to achieve the desired displacement, built-in volume ratio and number of turns. The principles of the method are described as follows:

1) The curvature of the outer portion of a first scroll element is designed in any conventional manner such that the desired displacement is satisfied;

2) The curvature of the inner portion of the first scroll element is also designed in any conventional manner such that the desired built-in volume ratio is satisfied;

3) The outer and the inner portions of the first scroll element are linked smoothly with an intermediate portion having a curvature that is chosen to satisfy the desired number of turns; and 4) A second scroll element is designed by deriving the mathematical conjugate of the first scroll element. The second scroll element is interfit with the first scroll element at an angular and radial offset.

The present invention is disclosed in connection with an air compressor in which the vane thickness and involute generating circle of both the outer and inner portions of the scroll elements are the same. The outer and inner portions of the scroll elements are constructed in a conventional manner to satisfy a given displacement and built-in volume ratio. They are then linked by an intermediate portion which has derivatives of zeroth and first order that are equal to the derivatives of the outer and inner portions at the junctions. The geometric configuration of the intermediate portion is chosen so that the optimum number of turns is achieved. Thus, continuous and smooth walls of spiral-shaped scroll elements are formed by respective outer, intermediate and inner portions, which provide the desired displacement, the desired built-in volume ratio and the optimum number of turns.

In a conventional scroll compressor, the scroll elements are made of involute curves. For a pair of scroll elements, the involute curves are geometrically identical and are developed from the same generating circle. In the first embodiment of the present invention, however, each scroll element includes several portions of involute curves which are developed from different generating circles, and yet, the two scroll elements remain identical in terms of geometric configurations and substantially convergent to the center of the end plate. In the second embodiment, the two scroll elements are geometrically different from each other. The first and the second embodiments are identified below as "identical" and "non-identical."

In another aspect of the present invention, the scroll-type fluid displacement device includes means for providing mechanical forces for urging two scroll members together in an axial operative relationship. At the same time, the potential for tipping the scroll members is eliminated and constant gaps are maintained between the extreme ends or tips of one scroll member and the base of the other scroll member.

In another aspect of the present invention, a scroll-type fluid displacement device includes means for providing hydraulic forces for urging two scroll members together in an axial operative relationship. At the same time, the potential for tipping the scroll members is eliminated and constant gaps are maintained between the tips of one scroll member and the base of the other scroll member.

In another aspect of the present invention, a scroll-type fluid displacement device includes a first non-orbiting scroll member which is movable in the axial direction. A second scroll member orbits about an axis, but is fixed linearly along this axis. The first and second scroll members are interfit, and the first scroll member is movably biased against the second scroll member such that the first scroll member will yield axially under sufficient force.

In yet another aspect of the present invention, the above-described scroll-type fluid displacement device includes a stabilizing mechanism for maintaining the first scroll member perpendicular to the axis of its scroll element, but movable along this axis in the rearward direction. At the same time, constant gaps are maintained between the extreme ends or tips of one scroll member and the base of the other scroll member.

BRIEF DESCRIPTION OF THE DRAWINGS

The invention will be better understood when considered in view of the following detailed description which makes reference to the annexed drawings in which.

DETAILED DESCRIPTION OF THE PRESENTLY PREFERRED EMBODIMENTS

Figure 1A:
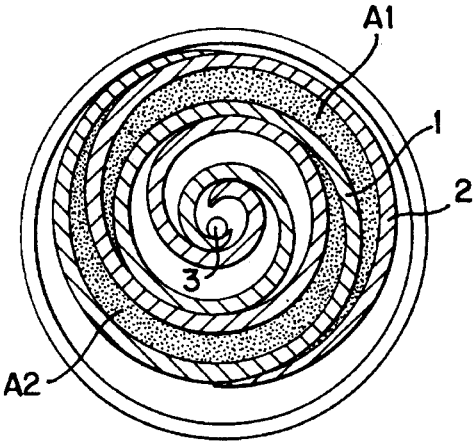
FIGS. 1*a*–1*d* are schematic views illustrating the relative orbital movement of the scroll elements in a conventional scroll compressor.
Figure 1B:
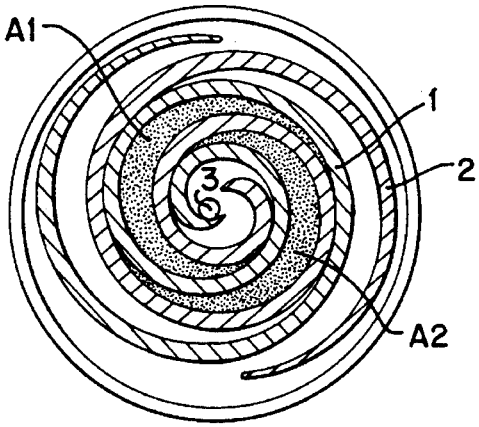
Figure 1C:
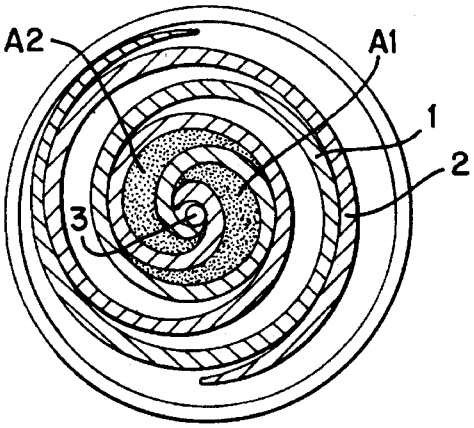
Figure 1D:
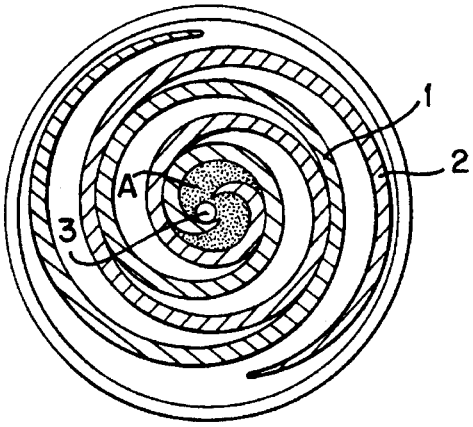
Figure 2:
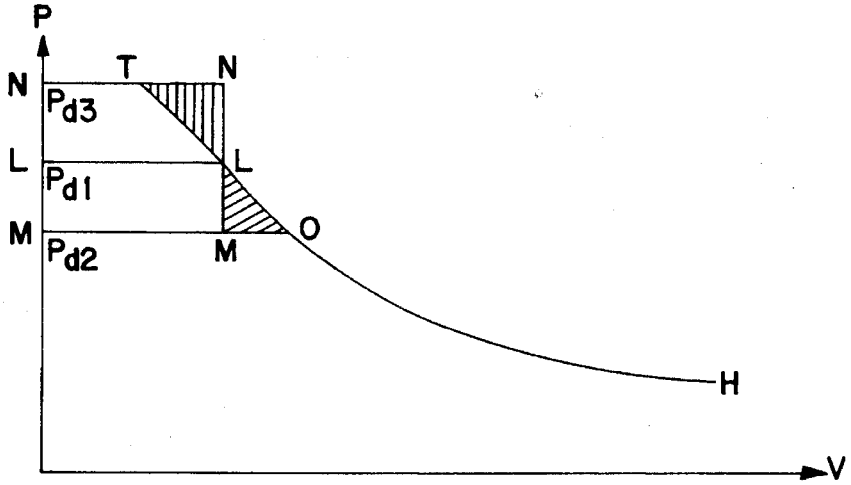
FIG. 2 is a pressure-volume diagram illustrating the compression cycle, including ideal compression, undercompression and overcompression.
Figure 3:
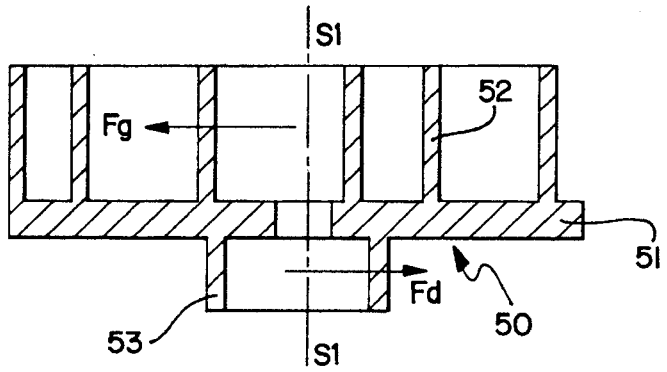
FIG. 3 illustrates the forces and moments acting on the orbiting scroll element.
Figure 4:
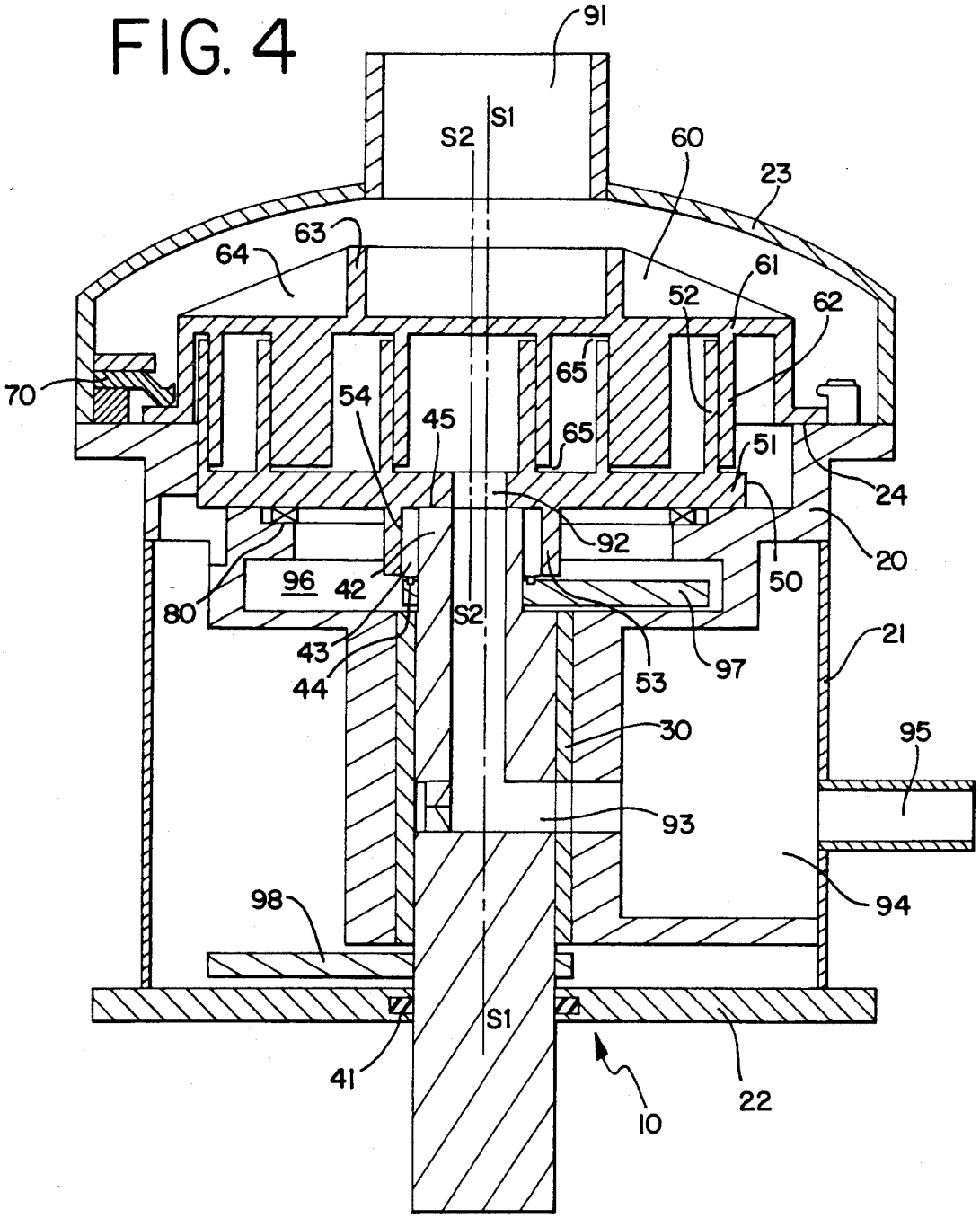
FIG. 4 illustrates a cross section of a scroll-type air compressor constructed in accord with the present invention.

Referring to FIG. 4, a scroll-type air compressor designed in accordance with the present invention is shown. The compressor unit 10 includes a main housing 20 and a compressor shell 21 having a front end plate 22 and a cup-shaped casing 23. The front plate 22 is attached to the compressor shell 21 in a known manner (e.g. welding). The shell 21 and casing 23 are attached to the main housing 20, also in a conventional manner (e.g. welding or bolting). The main housing 20 holds a main journal bearing 30. A main shaft 40 is rotatably supported by bearing 30 and rotates along its axis S1—S1 when driven by an electric motor or engine (not shown). A sealing element 41 seals the shaft 40 to prevent lubricant and air inside the shell from escaping. A drive pin 42 extrudes from the rear end of main shaft 40, and the central axis of drive pin, S2—S2, is offset from the main shaft axis, S1—S1, by a distance equal to the orbiting radius $R_{or}$ of the second scroll element. The orbiting radius is the radius of the orbiting circle which is traversed by the second scroll member 50 as it orbits relative to the first scroll member 60.

The first scroll member 60 has an end plate 61 from which a scroll element 62 extends. The first scroll member 60 is attached to the main housing 20 in a manner which may be referred to as "semi-compliant." Using this method of attachment, the first scroll member 60 is perpendicular to the axis S1—S1 and spring biased (by spring 70) against a surface 24 of the main housing 20. This assures that appropriate gaps, 65, are maintained between the tips of the scroll elements of one scroll member and the base of the end plate of the other scroll member.

These gaps should be wide enough to prevent the tips and bases of the scroll members from contacting each other after taking into consideration the manufacturing tolerances and thermal growth of the scroll elements during normal operation. On the other hand, the gaps must also be small enough to be sealed off hydrodynamically by a film of lubricant during normal operation. When an abnormal situation arises, such as the presence of contaminants or incompressible liquids between the scroll members, or when there is abnormal thermal growth of the scroll elements, the first scroll member yields axially (as measured linearly along the center axes of the scroll elements) against the urging force of the spring bias 70 to prevent damage. This arrangement is referred to as "semi-compliant" and is more fully described later in this application.

In addition to the circular end plate 61 and scroll element 62, the first scroll member 60 includes a reinforcing sleeve 63 and ribs 64. The first scroll member 60 is capable of making an excursion rearward in the axial direction. The scroll element 62 is affixed to and extends from the front end surface of the end plate 61, and the reinforcing sleeve 63 and ribs 64 extend from the rear surface of the end plate 61.

The second scroll member 50 includes a circular end plate 51, a scroll element 52 affixed to and extending from the rear surface of the end plate 51, and an orbiting bearing boss 53 affixed to and extending from the front surface of the end plate 51.

Scroll elements 52 and 62 are interfit at a 180 degree angular offset, and at a radial offset having an orbiting radius $R_{or}$. At least one pair of sealed off fluid pockets is thereby defined between scroll elements 52 and 62, and end plates 51 and 61. The second scroll member 50 is connected to a driving pin 42 (through a driving pin bearing 43) and a rotation preventing oldham ring 80. The second scroll member 50 is driven in an orbital motion at the orbiting radius $R_{or}$ by rotation of the drive shaft 40 to thereby compress fluid. The working fluid enters the compressor 10 from the inlet port 91, and is then compressed by the scroll members and discharged through discharge hole 92, passage way 93, chamber 94 and discharge port 95. The discharge gas is sealed off from chamber 96 by the bearing surface 54 between the pin bearing 43 and the pin bearing boss 53, and by a seal element 44. The discharge gas acts on the bottom surface 45 of the boss 53 to reduce the axial thrust force from the compressed fluid in the compression pockets during operation. Counterweights 97 and 98 balance the centrifugal force acting on the second scroll member 50 due to its orbiting motion.

Figure 5:
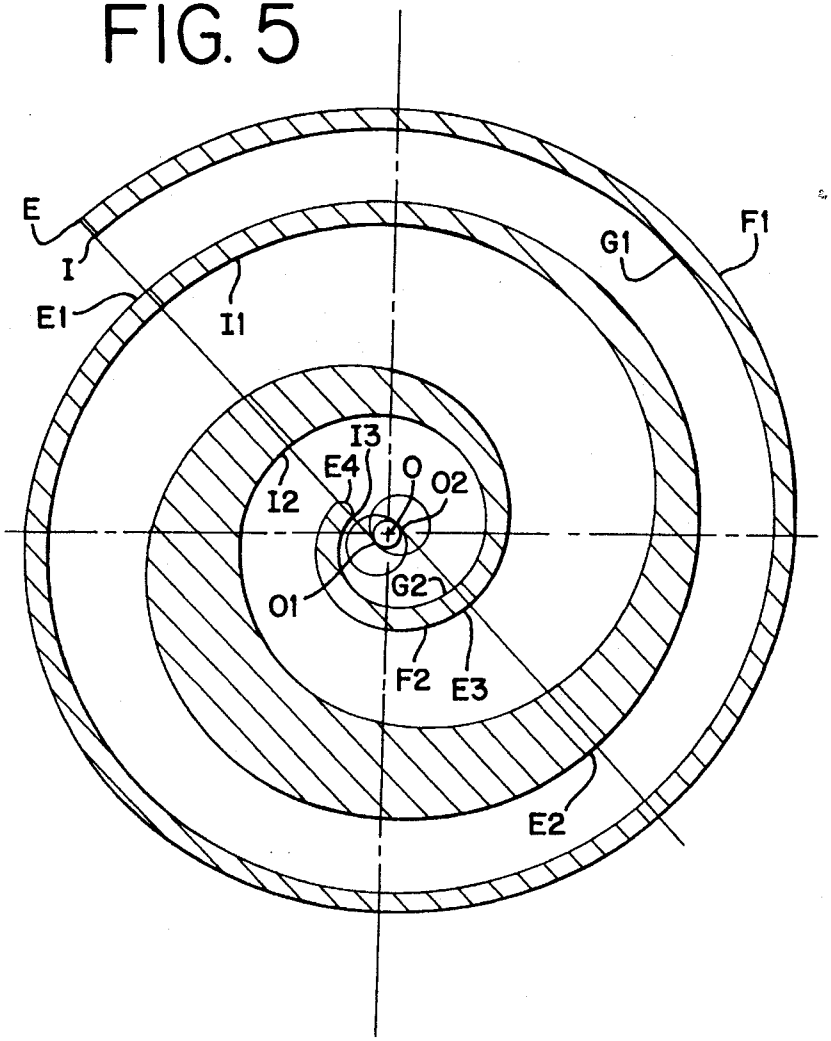
FIG. 5 illustrates a top cross-section view of a first embodiment of the present invention in which the scroll elements are substantially identical.

Referring to FIGS. 5, **6*a* and 6*b***, the geometric configurations of the scroll elements will now be described.

In the first embodiment of the present invention, the scroll elements of the two scroll members have substantially identical configurations. An example of one such scroll element is shown in FIG. 5. The design parameters of the first embodiment are as follows: displacement $V_H$=13 cubic inches per revolution per suction pocket; built-in volume ratio $R_V$=5.6; the radius of the base generating circle (a circle from which the internal and external involute surfaces of the scroll element are developed) $R_g$=0.14324 inch; the height of the spiral element h=2.0 inch; and the orbiting radius $R_{or}$=0.2 inch.

Figure 7:
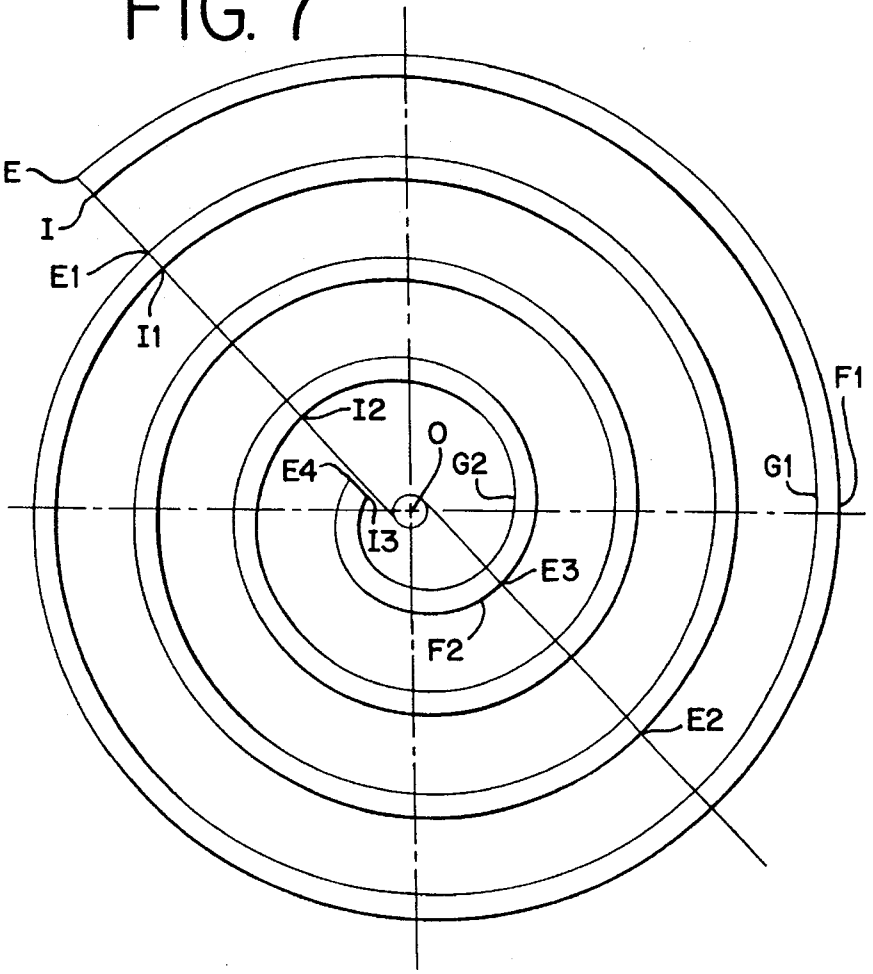
FIG. 7 illustrates a conventional scroll element from which the first and second embodiments of the invention are developed.

The wall surfaces of the scroll elements of the first embodiment are designed as follows:

1) Design a conventional spiral-shaped scroll element with the aforementioned design parameters. The resulting scroll element, as shown in FIG. 7, consists of approximately four complete turns and meets the above-described displacement and built-in volume ratio requirements. The starting and ending involute angles of the external wall surface of the scroll element are 224 degrees and 1663 degrees respectively. The center of the generating circle is at point O. This scroll element is defined as the base spiral element and its generating circle is defined as the base generating circle.

2) Select arcade surfaces $EF_1E_2$, $IG_1I_1$, $E_3F_2E_4$ and $I_2G_2I_3$ from the base spiral element shown in FIG. 7. These arcs are selected to satisfy the desired displacement and built-in volume ratio. In the first embodiment, the outer external surface $EF_1E_2$ spans an involute angle of 540 degree. The inner external surface $E_3F_2E_4$ spans an involute angle of 179 degree. The outer internal surface $IG_1I_1$ and the inner internal surface $I_2G_2I_3$ span an involute angles of 360 and 359 degrees, respectively. A complete turn of the outer portion of the spiral element shown in FIG. 7 is selected for both scroll elements of the first embodiment, hence, the displacement of the first embodiment is the same as the design shown in FIG. 7. However, for the inner portion of the scroll element, the selected external surface spans less than a complete turn. Consequently, the volume of final sealed compression pocket, and thus, the built-in volume ratio of the first embodiment, will be slightly different from the base design shown in FIG. 7. This will be taken care of later.

3) Link the external and the internal surfaces of the inner and outer portions of the scroll element. An intermediate involute arcade surface spans 360 degree of involute angle from $E_2$ to $E_3$ with the radius of the generating circle calculated as follows:

$$R_{g1}=(E_2E_3)/(2\pi)=2*R_g \quad (1)$$

wherein $R_g$ and $R_{g1}$ are the radii of generating circles centered at O and $O_1$, respectively as shown in FIG. 5. The generating circles O and $O_1$ share the same tangents at end points $E_2$ and $E_3$ of the external surfaces, respectively. Similarly, to link the internal surfaces of the inner and outer portions of the spiral element of the first embodiment, an intermediate involute arcade surface spans 360 degree of involute angle from $I_1$ to $I_2$ with the radius of the generating circle calculated as follows:

$$R_{g2}=(I_1I_2)/(2\pi)=2*Rg \quad (2)$$

where $R_g$ and $R_{g2}$ are the radii of generating circles centered at O and $O_2$, respectively as shown in FIG. 5. The generating circles O and $O_2$ share the same tangents at end points $I_1$ and $I_2$ of the internal surfaces, respectively. Thus, the actual number of turns in the final scroll design shown in FIG. 5 includes one complete turn in the outer portion, plus the less than one complete turn in the inner portion, plus the one complete turn from the intermediate portion. Accordingly, the actual number of turns (approximately 3) is at least about one full turn less than the initial number of turns (approximately 4) given by the conventional spiral-shaped scroll element (shown in FIG. 7) that was generated as the first step in the design process. Due to the introduction of the intermediate portion of the scroll elements, the volume of the final sealed compression pocket for the scroll element shown in FIG. 7 is slightly larger than the volume of the final sealed compression pocket for the scroll element shown in FIG. 5. To compensate for this difference, one can increase the starting involute angle of the inner portion of the scroll element in the first embodiment or relocate the discharge hole such that the volume of final sealed compression pocket increases. Often, however, the change in the built-in volume ratio is insignificant, and thus modification is unnecessary.

Figure 8:
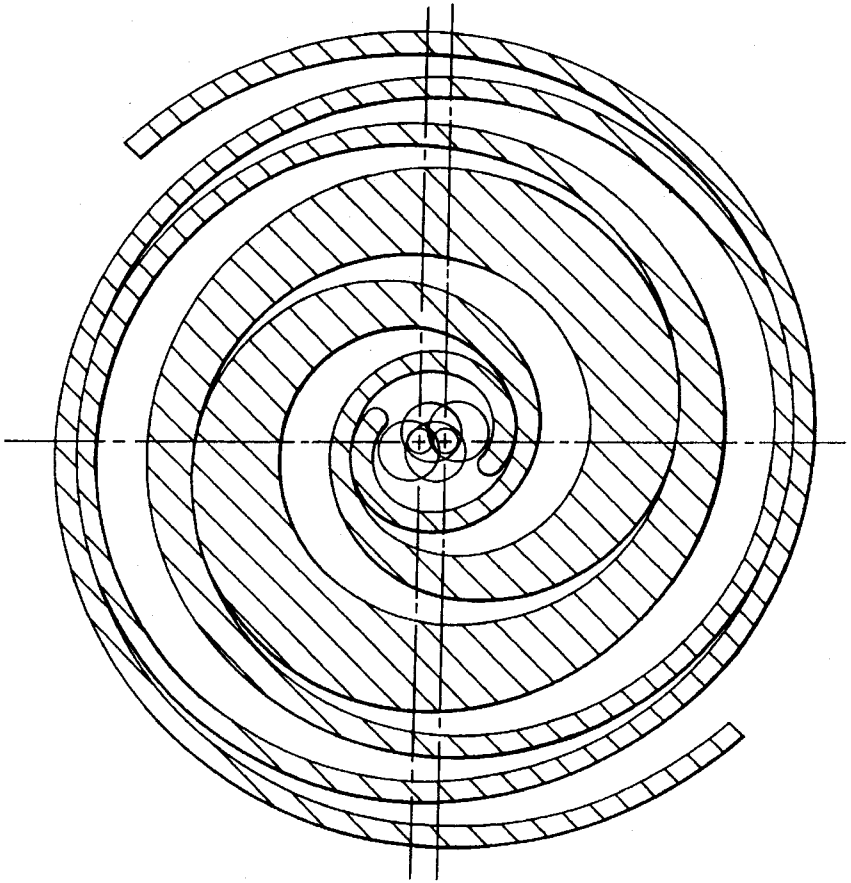
FIG. 8 illustrates the interfitting scroll elements of the first embodiment.
Figure 10:
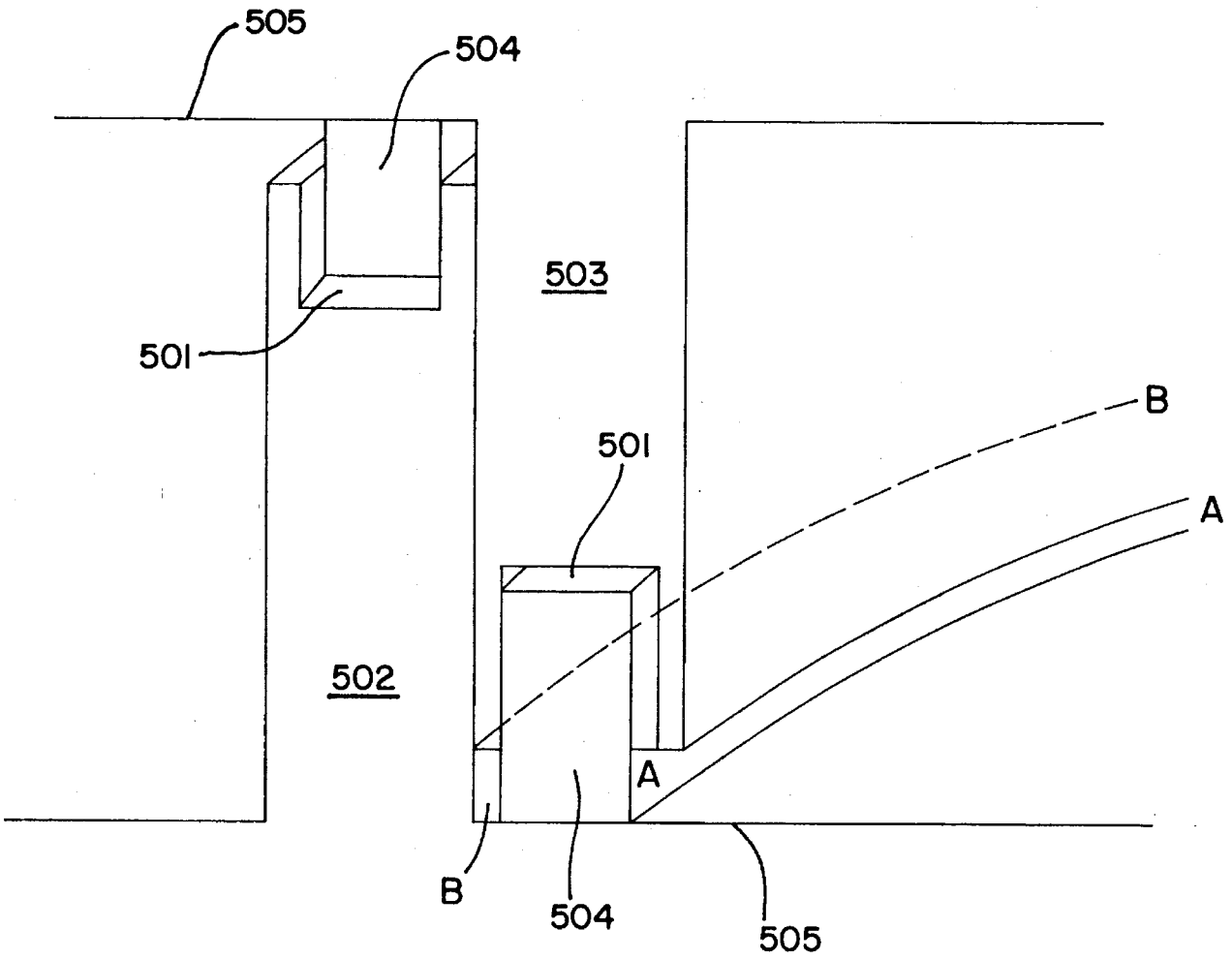
FIG. 10 PRIOR ART
FIG. 10 illustrates a typical structure for a conventional tip seal.

4) Design a scroll element that is mating conjugate to the scroll element shown in FIG. 5. Deriving a conjugate of a curved surface is a well known manipulation, and thus it is not necessary to recite the details of this procedure here. The terms "mating conjugate" are used to indicate the whatever conjugate is derived must be such that the requisite line contacts (and containment pockets) are established and maintained when the scroll elements are interfit and orbited with respect to each other. In the first embodiment, the conjugate is identical to the original. The two "identical" scroll elements are shown together in FIG. 8.

Figure 6B:
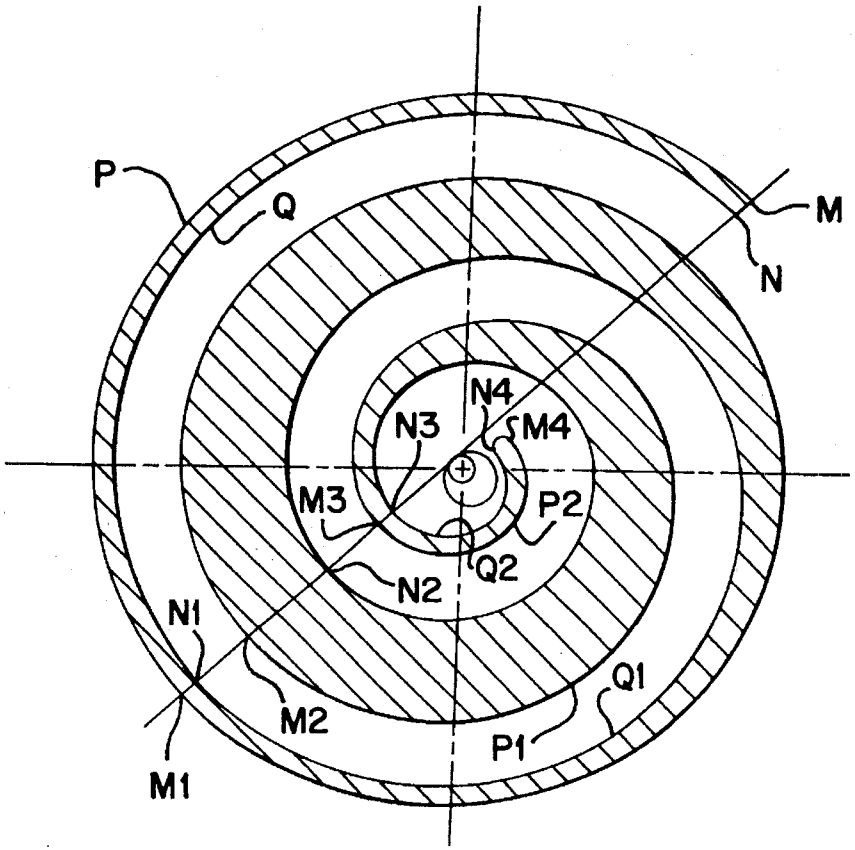
FIGS. 6*a* and 6*b* illustrate top cross-section views of a second embodiment of the present invention in which the scroll elements are substantially non-identical.
Figure 6A:
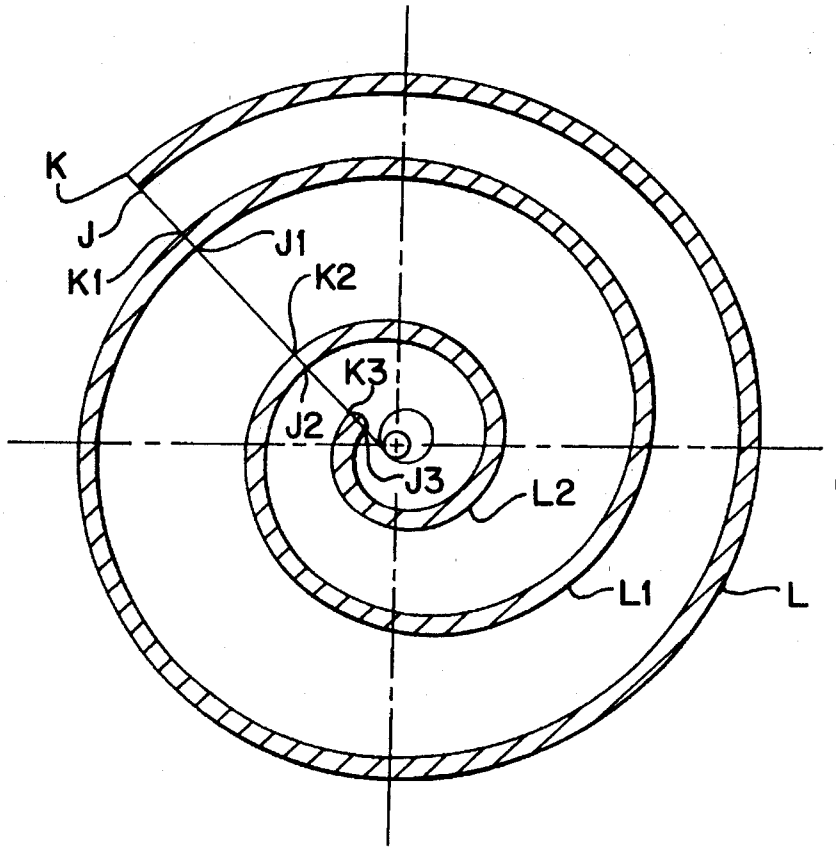

The second embodiment of the present invention is described herein as "non-identical" and shown in FIGS. 6*a* and 6*b*. The general design specifications are the same as the first embodiment. However, for the second embodiment, the second scroll element has uniform wall thickness, as shown in FIG. 6*a*. In comparison to the first embodiment, it is lighter in weight, and therefore causes less centrifugal force during its orbiting motion.

The scroll element shown in FIG. 6*a* consists of three spiral portions. Both inner and outer portions are approximately a full turn of spiral wall taken directly from the conventional scroll element shown in FIG. 7. More specifically, in FIG. 6*a*, the external surface of the inner portion, $K_2L_2K_3$, spans from a starting involute angle of 224 degrees to an ending angle of 583 degrees with a generating circle radius of 0.14324 inch. The external surface of the outer portion, $KLK_1$, spans from a starting involute angle of 1303 degrees to the ending angle of 1663 degrees, with the same generating circle radius. The external surface of the intermediate portion, the involute surface $K_2L_1K_1$, whose generating circle radius is $$R_{g3}=(K_1K_2)/(2\pi)=2*Rg \quad (3)$$

smoothly and continuously links the inner and the outer portions of the external surfaces of the spiral wall. The internal surface of the scroll element shown in FIG. 6*a* is parallel to its external surface, and the wall thickness (t) is approximately 0.2 inch. The scroll element shown in FIG. 6*b* is the mating conjugate of the scroll element shown in FIG. 6*a*, but they are not identical.

The external surface of the second scroll element shown in FIG. 6*b* consists of three portions of spiral curves, i.e., $MPM_2$, $M_2P_1M_3$ and $M_3P_2M_4$. The outer and inner surfaces $MPM_2$ and $M_3P_2M_4$ are involute with a generating circle radius Rg=0.14324 inch. These surfaces span from a starting involute angle of 224 degrees to an ending angle of 403 degrees for the inner portion, and from a starting involute angle of 1123 degrees to an ending angle of 1663 degrees for the outer portion. The intermediate portion $M_2P_1M_3$ is an involute of the generating circle radius $$R_{g4}=M_2M_3/(2*\pi)=2*R_g \quad (4).$$

The internal surface of the scroll element shown in FIG. 6*b* also consists of three portions, $NQN_1$, $N_1Q_1N_2$ and $N_2Q_2N_4$. The inner and outer portions span from a starting involute angle of 224 degrees to an ending angle of 763 degrees for the inner portion, and from a starting involute angle of 1483 degrees to an ending angle of 1663 degrees for the outer portion, respectively. The intermediate portion of the internal surface $N_1Q_1N_2$ continuously and smoothly links the inner and the outer portions and shares the same generating circle with the intermediate portion of the external surface.

Figure 9:
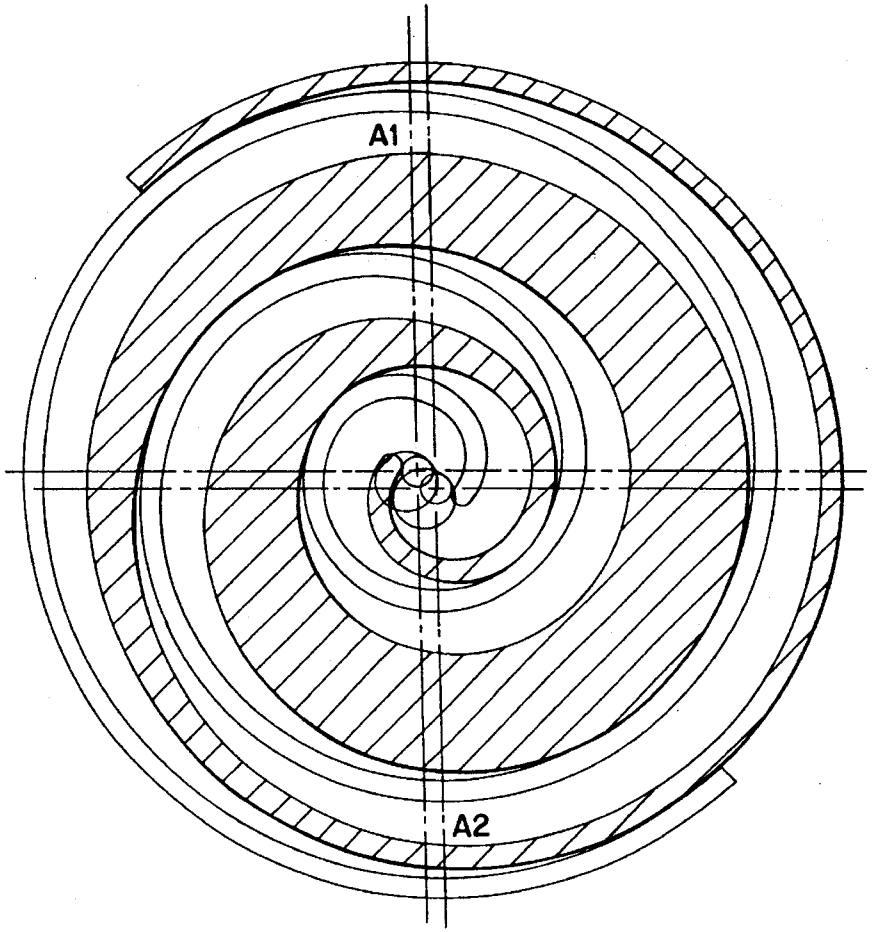
FIG. 9 illustrates the interfitting scroll elements of the second embodiment.

FIG. 9 shows the two non-identical scroll elements interfit with each other during operation. Because of the intermediate portion, the volumes of the suction pockets and the final sealed compression pockets are slightly different from the specifications. It is easy to adjust this by slightly changing the spanning involute angle of the outer and/or inner portions of the internal and the external surfaces of the scroll elements. Due to the non-identical nature of the two scroll elements, the volumes of the pair of compression pockets, A1 and A2, as shown in FIG. 9, differ from each other by a small amount which is not significant in most applications. The same situation happens to the volumes of the final compression pockets and the built-in volume ratios. To compensate for these differences, one can adjust the starting involute angle of the inner portion of the scroll element. Often, the deviation of the built-in volume ratio from the original specifications is not significant, and an adjustment is unnecessary.

Referring to FIGS. 11–13, three embodiments of a semi-compliant mechanism made according to the present invention will now be described.

Figure 11B:
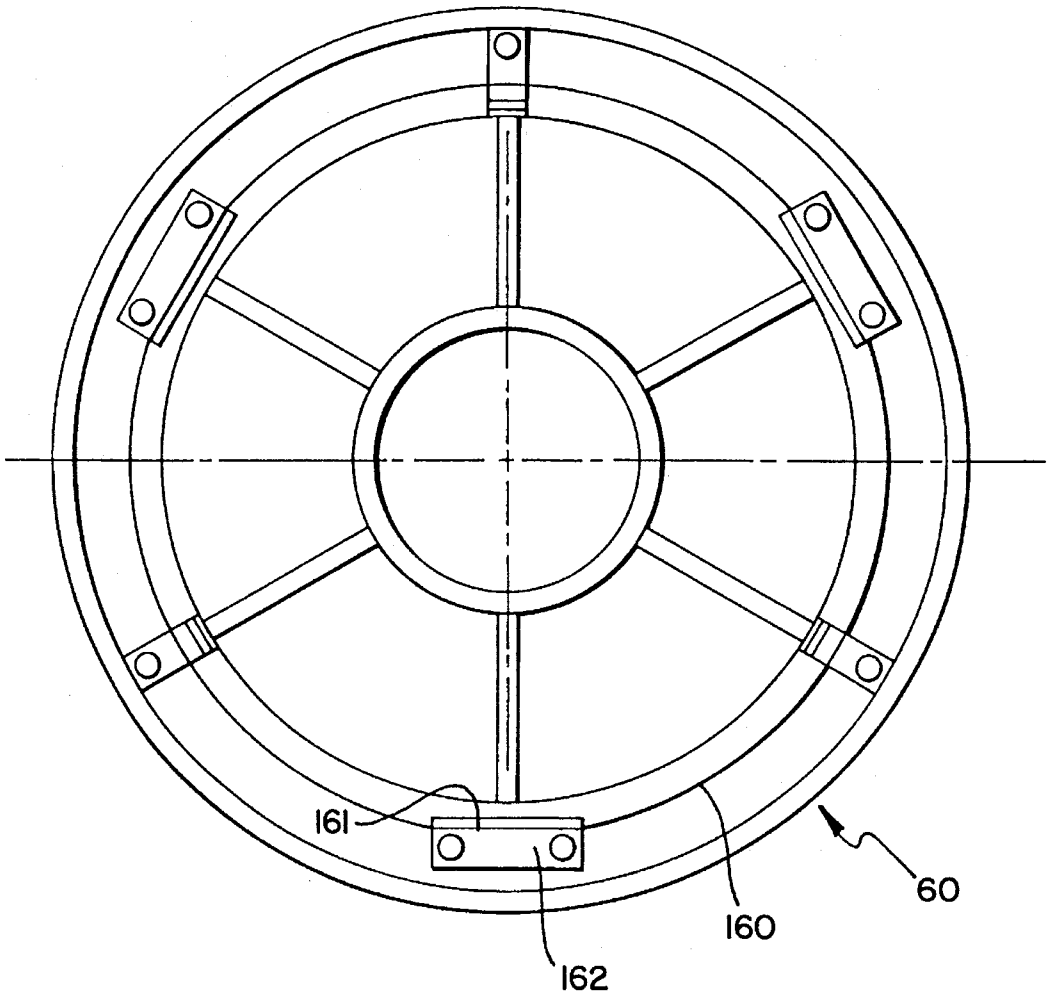
FIGS. 11*a* and 11*b* illustrate cross section and top views of a first embodiment of the axial semi-compliant mechanism of the present invention.
Figure 11A:
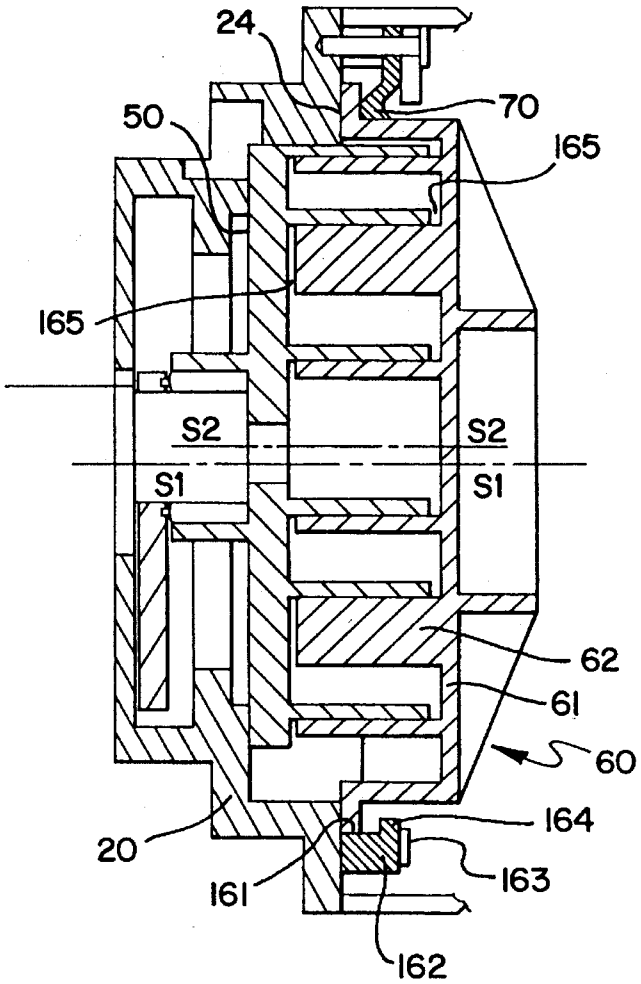

For the first embodiment, as shown in FIGS. 11*a* and 11*b*, the outer peripheral surface 160 of the end plate 61 of the first scroll member 60 has three equally spaced flat edges 161. Three positioning blocks 162 form a stabilizing mechanism which prevents the first scroll member from "tipping." The blocks 162 are affixed to the main housing 20 by bolts 163. The blocks 162 fit tightly against the flat edges 161 of the end plate 61 such that the scroll member 60 remains perpendicular to the axis S1—S1, but can make axial excursions rearward under the guidance of blocks 162. The term "axial" is used herein to refer to linear movement along a particular axis, as opposed to rotational movement around a particular axis. The first scroll member 60 is urged by springs 70 towards the second scroll member 50 until it is stopped by the surface 24 of the main housing 20. This assures appropriate gaps 165 between the tip of one scroll member and the base of the other scroll member.

The second scroll member 50 is also stabilized to prevent it from tipping. The stabilization mechanism for the second scroll member 50 is provided by the housing 20 which acts as a thrust bearing on one side of the end plate, and by the large gas pressure in the space between the scroll members, 50, 60.

The gaps 165 must be sufficiently large to insure that there is no tip-base contact during normal operation. On the other hand, the gaps 165 must be sufficiently small that the leakage flow of the working fluid through the gaps is either insignificant in comparison to the fluid displaced or can be totally sealed off by lubricant film formed between the tips and bases of the scroll members during normal operation. As an example, a cast iron scroll compressor having a height in the axial direction of 2 inches would, under the disclosed design, call for a gap 165 of 0.0030 inches under cold conditions. When the separating force acting on the front side of the first scroll member 60 exceeds the urging force of the spring bias, typically due to abnormal operating conditions, the first scroll member 60 makes an axial excursion rearward until it is stopped by the limiting lip 164 of the positioning blocks 162.

Figure 12B:
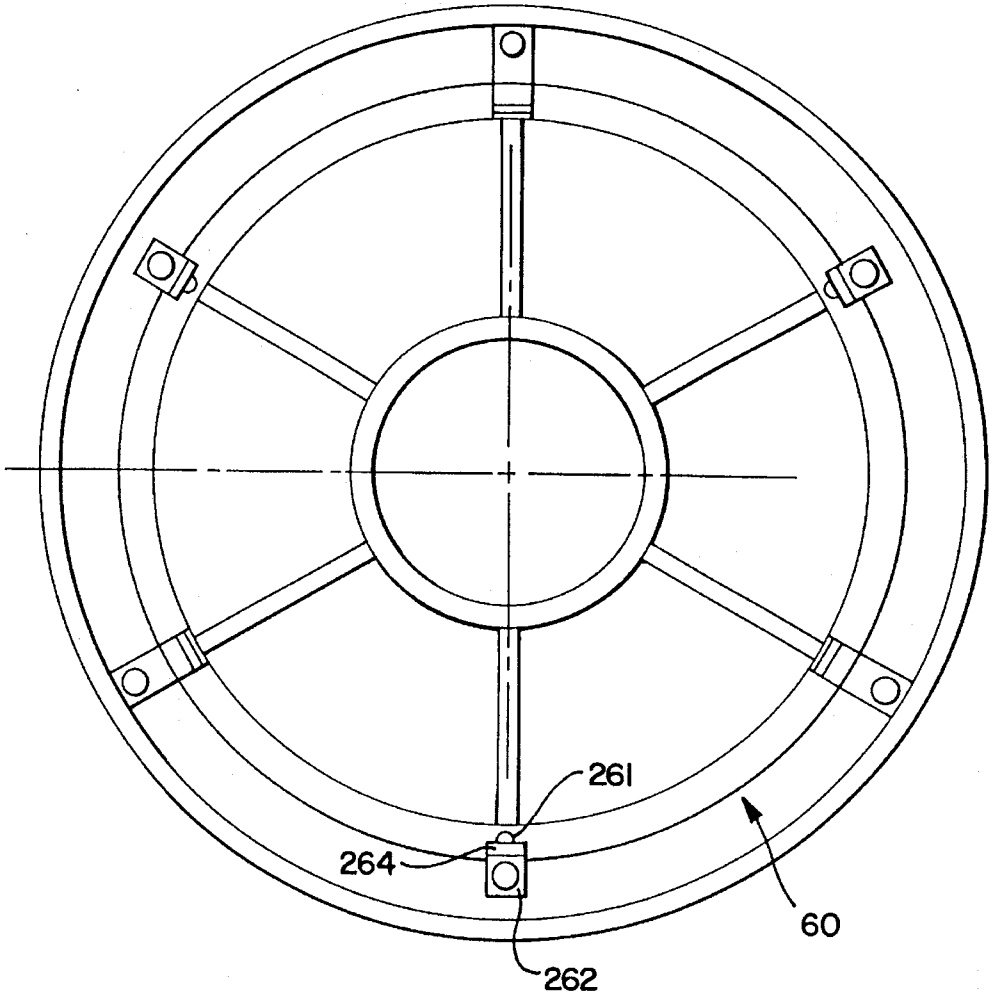
FIGS. 12*a* and 12*b* illustrate cross section and top views of a second embodiment of the axial semi-compliant mechanism of the present invention.
Figure 12A:
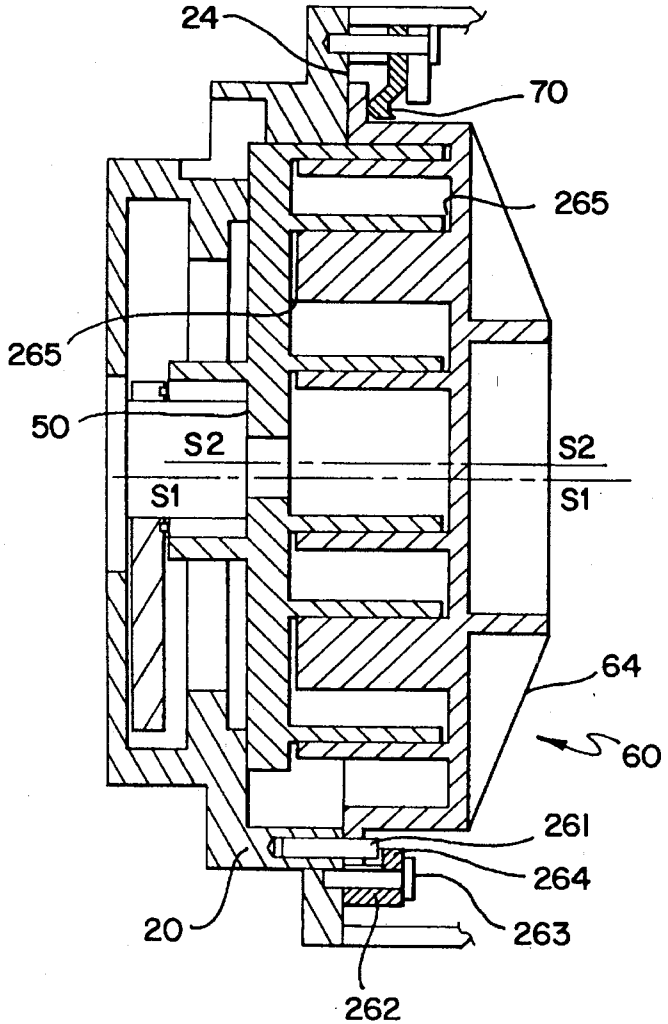

FIG. 12*a* and 12*b* illustrate a second embodiment of the present invention. The first scroll member 60 is stabilized and affixed to the main housing 20 by three stabilizing pins 261, which prevent the first scroll member 60 from rotating or "tipping." The first scroll member 60 is urged by springs 70 towards the second scroll member 50 until it is stopped by the surface 24 of the main housing 20. This assures appropriate gaps 265 between the tip of one scroll member and the base of the other scroll member. When the separating force acting on the front side of the first scroll member 60 exceeds the urging force of the spring bias, the first scroll member 60 will make an axial excursion rearward until it is stopped by the limiting lip 264 of the positioning blocks 262. The blocks 262 are secured to the main housing 20 by bolts 263.

Figure 13B:
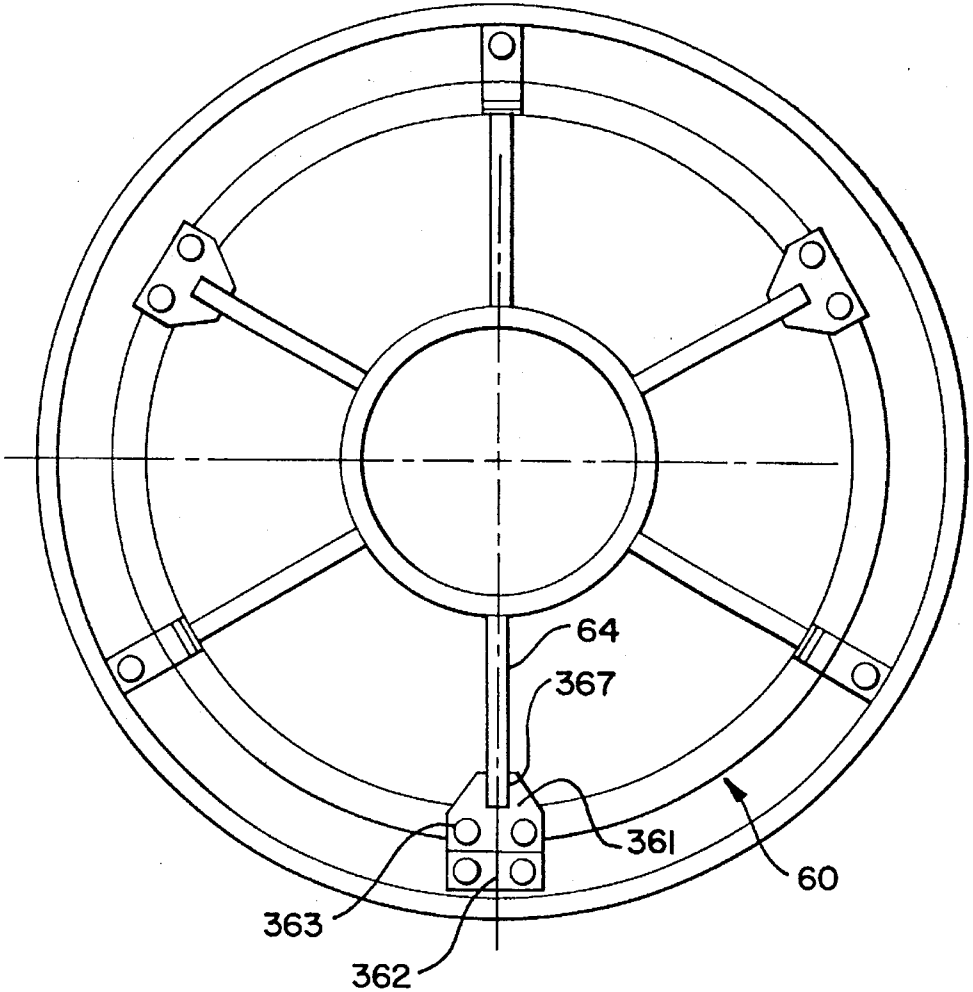
FIGS. 13*a* and 13*b* illustrate cross section and top views of a third embodiment of the axial semi-compliant mechanism of the present invention.
Figure 13A:
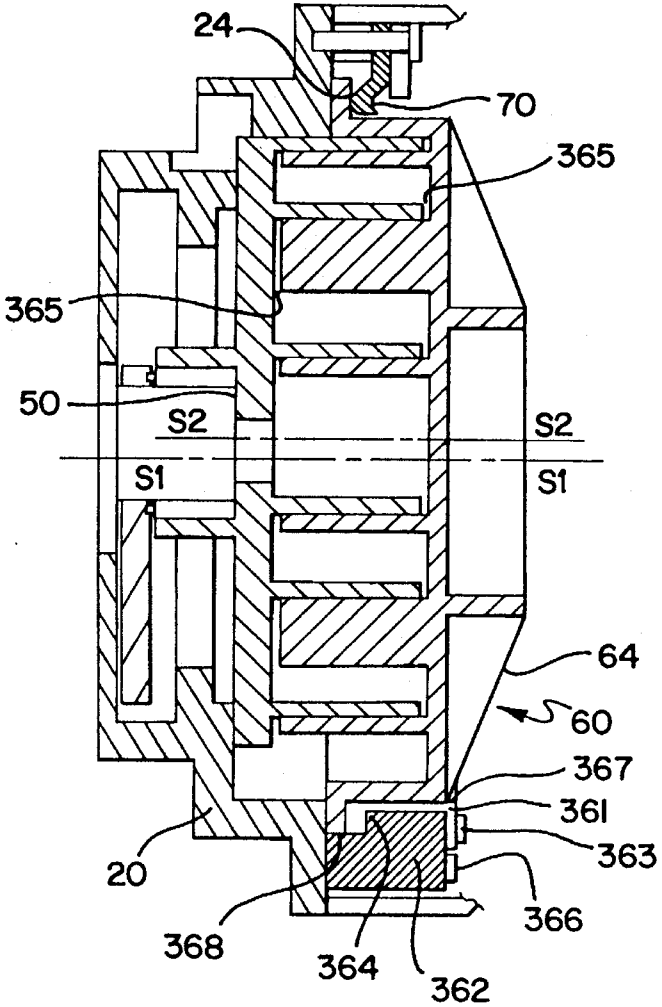

FIGS. 13*a* and 13*b* illustrate a third embodiment of the present invention. Three elastic positioning plates 361 are affixed to stabilizing blocks 362 by bolts 363. The blocks 362 are affixed to the main housing 20 by bolts 366. The plates 361 have slots 367, which tightly hold the ribs 64 of the first scroll member 60 to stabilize the first scroll member 60 and prevent it from rotating or tipping in a plane perpendicular to the axis S1—S1, but allowing it to make an axial excursion rearward due to the elasticity of the plates 361. The stabilizing blocks 362 tightly hold the first scroll member 60 at the edge 368 to prevent the first scroll member 60 from "tipping." The first scroll member 60 is urged by springs 70 towards the second scroll member 50 until it is stopped by the surface 24 of the main housing 20. This assures appropriate gaps 365 between the tip of one scroll member and the base of the other scroll member. When the separating force acting on the front side of the first scroll member 60 exceeds the urging force of the spring bias, the first scroll member 60 makes an axial excursion rearward until it is stopped by the limiting lip 364 of the stabilizing blocks 362.

Figure 14:
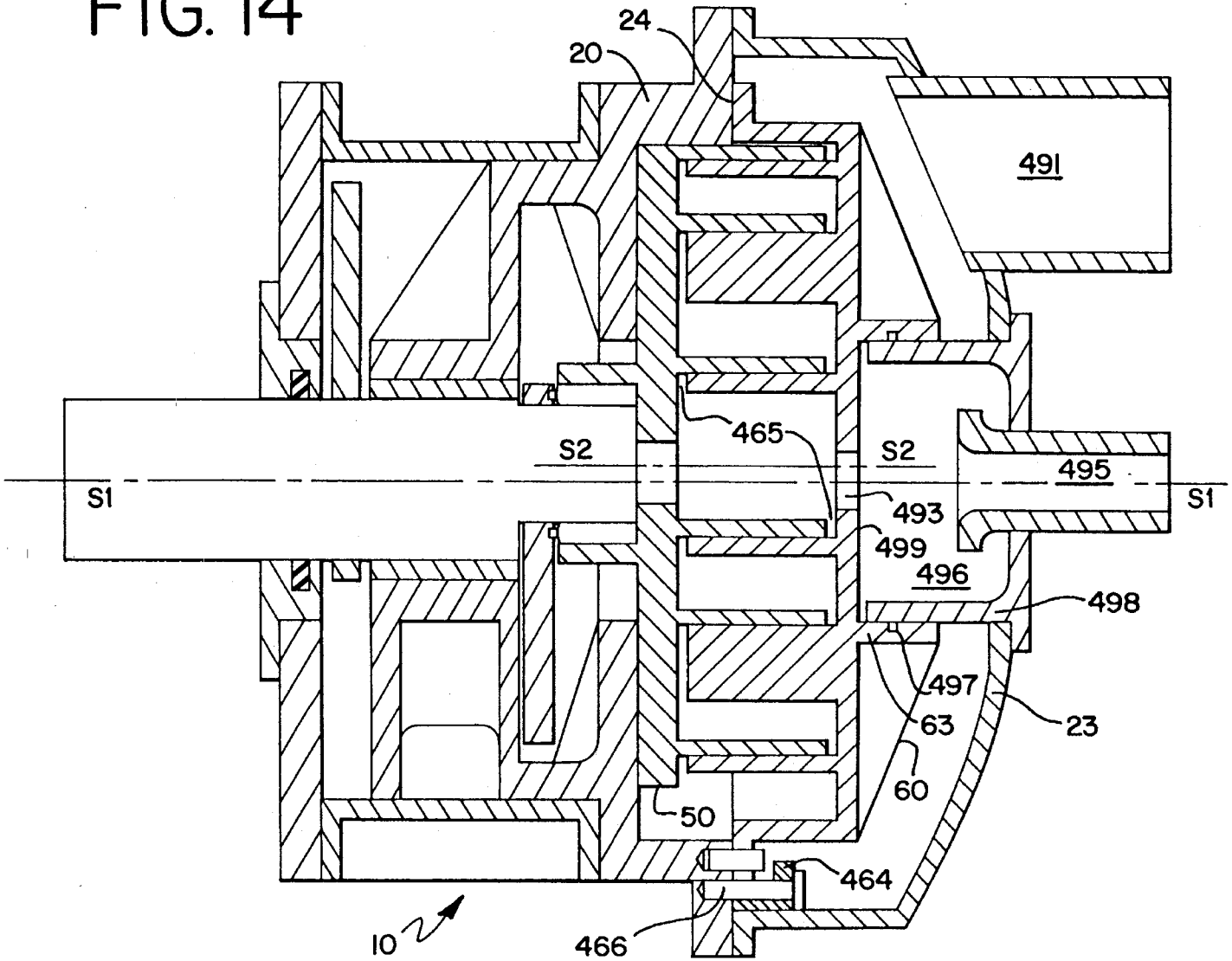
FIG. 14 illustrates a cross section and top view of a scroll-type air compressor with a semi-compliant scheme in which a gas, at discharge pressure, acts on the rear side of the first scroll member to provide an axial biasing force.

FIG. 14 shows a cross section of a fourth embodiment of the present invention. The basic operating principles of this embodiment are the same as the device shown in FIG. 4. In this embodiment, however, a discharge gas is employed to provide the axial biasing force. Thus, FIG. 14 illustrates a modified version of the compressor shown in FIG. 4, and these modifications are discussed below.

As shown in FIG. 14, air enters compressor 10 through inlet port 491, and is then compressed by the scroll members, 50 and 60, and discharged through discharge hole 493 and discharge port 495. Discharge gas is sealed off in a discharge chamber 496 by O-ring 497, and by providing close tolerance between sleeve 63 and lid 498. The sleeve 63 and lid 498 also provide an additional stabilization mechanism for the scroll members, 50, 60. Discharge port 495 is welded to lid 498 which is bolted to casing 23. Discharge gas exerts bias force on the rear surface 499 of sleeve 63. The area of surface 499 is chosen so that the bias force slightly exceeds the separating force acting on the front surface of the first scroll member 60 during normal operation. The first scroll member 60 is thus urged towards the second scroll member 50 and is stopped by surface 24 of the main housing 20 to ensure appropriate gaps 465 between the tips and bases of the two scroll members 50, 60. The stabilizing pins 466 prevent the first scroll member 60 from rotating in the plane perpendicular to the axis $S_i$—$S_i$ and also prevent it from "tipping." When abnormal operating conditions occur, such as those described previously herein, the first scroll member 60 yields rearward in the axial direction against the bias force until it is stopped by lip 464.

While the above-described embodiments of the invention are preferred, those skilled in this art will recognize modifications of structure, arrangement, composition and the like which do not part from the true scope of the invention. The invention is defined by the appended claims, and all devices and/or methods that come within the meaning of the claims, either literally or by equivalents, are intended to be embraced therein.

I claim:

1. A scroll-type displacement apparatus comprising:

a first scroll member having a first scroll element having a first internal face and a first external face;

a second scroll member having a second scroll element having a second internal face and a second external face;

said first scroll element and said second scroll element positioned relative to one another such that they meet at line contacts between said first internal face and said second external face, and between said first external face and said second internal face;

said line contacts moving along said first internal face, said second external face, said first external face and said second internal face when said first and second scroll elements are moved relative to each other;

working surfaces on said first and second scroll elements defined by the areas traversed by said line contacts as said first and second scroll elements are moved relative to each other;

said working surfaces of said first internal face and said second external face forming part of a first fluid pocket;

said working surfaces of said first external face and said second internal face forming part of a second fluid pocket;

each of said working surfaces comprising more than one curve, said curves each having a generating circle which has a radius and a center, said curves converging toward a central point that is approximately the same as said center of said generating circles of said curves;

each of said working surfaces having a first portion having one of said more than one curves;

said first portion converging to a central point;

the radius of the generating circle of said one of said more than one curve chosen such that, if said first portion were continued to said central point, said first portion would provide an initial number of turns;

each of said working surfaces further having a second portion having another of said more than one curve, the radius of the generating circle of said another of said more than one curve chosen so that said first scroll element has an actual number of turns that is at least about one turn less than said initial number of turns.

2. The apparatus of claim 1 further comprising a biasing mechanism for establishing gaps between said first and second scroll members in the axial direction.

3. The apparatus of claim 2 wherein said biasing mechanism allows said first scroll member to yield away from said second scroll member under a separating force generated by abnormal operating conditions.

4. The apparatus of claim 1 further comprising:

a first stabilizing mechanism for preventing said first scroll member from tipping; and a second stabilizing mechanism for preventing said second scroll member from tipping.

5. A scroll-type displacement apparatus comprising:

a first scroll element having a first internal face and a first external face;

a second scroll element having a second internal face and a second external face;

said first scroll element and said second scroll element positioned relative to one another such that they meet at line contacts along said first internal face, said first external face, said second internal face, and said second external face;

said line contacts moving along said first internal face, said first external face, said second internal face, and said second external face when said first and second scroll elements are moved relative to each other;

working surfaces on said first and second scroll elements defined by the area traversed by said line contacts as said first and second scroll elements are moved relative to each other;

said working surfaces of said first internal face and said second external face forming part of a first fluid pocket;

said working surfaces of said first external face and said second internal face forming part of a second fluid pocket;

each of said working surfaces comprising more than one curve, said more than one curve each having a generating circle which has a radius and a center, said more than one curve converging toward a central point that is approximately the same as said center of said generating circles of said more than one curve;

one of said curves on each of said working surfaces converging toward said central point such that, if said one of said curves were continued to said central point, said one of said curves would provide an initial number of turns; and another of said curves on each of said working surfaces having a generating circle which has a radius chosen so that said first scroll element has an actual number of turns that is at least about one turn less than said initial number of turns.

6. The apparatus of claim 5 having a built-in volume ratio greater than 2.5.

7. The apparatus of claim 5 wherein said another of said curves comprises a predetermined curvature chosen to satisfy the desired displacement of the apparatus.

8. The apparatus of claim 5 wherein said each of said working surfaces further comprises a third curve having a predetermined curvature chosen to satisfy a desired built-in volume ratio of the apparatus.

9. The apparatus of claim 8 wherein the desired built-in-volume ratio comprises greater than 2.5.

10. The apparatus of claim 5 wherein said actual number of turns is less than about four.

11. The apparatus of claim 5 wherein said curves are involute spirals.

12. A method of designing the scroll elements of a scroll-type fluid displacement apparatus, the steps comprising:

a) designing a first scroll element having an internal working surface with a first internal portion and a second internal portion, and further having an external working surface with a first external portion and a second external portion;

b) designing a second scroll element having an external working surface conjugate to said first scroll element's internal working surface, and further having an internal working surface conjugate to said first scroll element's external working surface, said first scroll element and said second scroll element meeting at line contacts when said first and second scroll elements are positioned relative to one another, said line contacts moving along said working surfaces when said first and second scroll elements are moved relative to each other, said working surfaces defined by the area traversed by said line contacts as said first and second scroll elements are moved relative to each other, said internal working surface of said first scroll element and said external working surface of said second scroll element forming part of a first fluid pocket, said external working surface of said first scroll element and said internal surface of said second scroll element forming part of a second fluid pocket;

c) designing each of said working surfaces such that it comprises more than one curve, said more than one curve each having a generating circle which has a radius and a center, said more than one curve each converging toward a central point that is approximately the same as said centers of said generating circles of said more than one curve;

d) designing said each of said first portions to have one of said more than one curves which, if said first portion were continued to said central point, would provide an initial number of turns; and e) designing each of said second portions to have another of said more than one curves chosen to provide actual number of turns that is at least about one turn less than said initial number of turns.

13. The method of claim 12 further comprising the step of:

f) designing each of said first portions such that its predetermined curvature satisfies a desired displacement of the apparatus.

14. The method of claim 12 further comprising the step of:

f) designing a third portion of each of said working surfaces to have a predetermined curvature that satisfies a desired built-in-volume ratio of the apparatus.

15. The method of claim 14 wherein the desired built-in-volume ratio comprises greater than about 2.5.

16. The method of claim 12 wherein said actual number of turns comprises less than about four turns.

17. The method of claim 12 wherein said curvatures are involute spirals.

18. The apparatus of claim 14 wherein each of said second portions is smoothly linked with one of said first portions and one of said third portions.

* * * * *